US005429282A

United States Patent [19]

Stebick

[11] Patent Number: 5,429,282

[45] Date of Patent: Jul. 4, 1995

[54] MULTI-POSITION SELF-GUIDING CLOSURE FOR A CONTAINER

[75] Inventor: Matthew E. Stebick, Waterford, Pa.

[73] Assignee: Erie Plastics, Corry, Pa.

[21] Appl. No.: 221,243

[22] Filed: Mar. 31, 1994

[51] Int. Cl.[6] ..... B67D 5/06

[52] U.S. Cl. ..... 222/521; 222/520; 222/524; 222/525; 222/547; 222/560

[58] Field of Search ..... 222/519, 520, 521, 522, 222/523, 524, 525, 541, 547, 549, 560, 561, 564, 568

[56] References Cited

U.S. PATENT DOCUMENTS

| | | | |
|---|---|---|---|
| 3,319,843 | 5/1967 | Stull | 222/521 X |
| 4,475,670 | 10/1984 | Rutter | 222/519 X |
| 4,805,807 | 2/1989 | Perne et al. | 222/521 X |
| 4,927,065 | 5/1990 | Beck | 222/520 |
| 4,967,941 | 11/1990 | Beck | 222/521 |
| 5,141,129 | 8/1992 | Jennings | 222/519 X |

*Primary Examiner*—Andres Kashnikow
*Assistant Examiner*—Joseph A. Kaufman
*Attorney, Agent, or Firm*—Oliff & Berridge

[57] ABSTRACT

A multi-position self-guiding cap for attachment to a container. A tip of a cap assembly is mounted over a post section of a shell such that a guiding rib of the tip engages with a guiding channel and an annular groove of the shell. The annular channel allows circumferential movement of the tip relative to the shell. The guiding channel is preferably of a U-shape having a trunk branch and two side branches. The guiding channel defines the different positions of the cap. In moving between the respective positions, the user merely moves the tip in one direction to change states.

13 Claims, 5 Drawing Sheets

MULTI-POSITION SELF-GUIDING CLOSURE FOR A CONTAINER

BACKGROUND OF THE INVENTION

1. Field of the Invention

This invention relates generally to a cap or closure assembly for a container, and more particularly, to a multi-position self-guiding cap.

2. Description of Related Art

Plastic bottles typically have caps that are twisted or pulled open to dispense fluid. An example of a conventional squeeze bottle is a typical cleanser bottle commonly used for dishwashing detergent. This bottle typically has a shell portion secured to the bottle body with a single, solid central stem surrounded by an annular channel with openings therein for fluid to pass from the bottle body to the cap. A tip is axially movably disposed on the shell with one large central opening that sealingly engages the stem in the closed position and is spaced from the stem in the open position. In operation, the tip is merely pulled up to dislodge the stem from the aperture whereby fluid can be dispensed from the bottle body.

Other types of conventional caps function by twisting. In these types of caps, a dispensing aperture is located off center of the tip of the cap. The shell is secured to the container body and has an upstanding stem positioned off center and aligned with the aperture in the tip. In a closed position, the stem covers and seals the aperture. In operation, the tip is rotated to one side, thus uncovering the aperture and allowing fluid to flow from the container body through the cap.

Some of these twisting type caps offer both a spray and a stream feature. In these caps, there is a spray opening and a stream opening both provided off center on the tip of the cap. An enlarged stem, which is generally arc-shaped, is disposed beneath both the spraying aperture and the stream aperture in the closed position. In operation, a user twists the tip of the cap to displace the desired aperture from the stem. Thus, twisting in one direction will uncover, for example, the spraying aperture and twisting in the other direction will uncover the stream aperture.

U.S. Pat. No. 4,927,065 to Beck discloses an adjustable metering closure cap used in both a screw type and a push-pull type operation to provide different dispensing openings. The inner periphery of the cap body cooperates with the outer periphery of the post to provide the closed and dispensing positions. However, in such an apparatus, the user determines the rotational position of the cap body relative to the inner post without any means for restricting movement of the cap body relative to the post.

SUMMARY OF THE INVENTION

Accordingly, it is a primary of the invention to provide a multi-position self-guiding closure apparatus for a container preferably of drinking water.

To achieve this and other objects, the invention proposes a multi-position self-guiding cap comprising a shell, a tip and a guiding channel. The shell has a post section with an aperture for dispensing liquid from the container. The tip is mounted on the external cylindrical surface of the post section for axial movement in the longitudinal direction and rotational movement in a circumferential direction to selectively open and close the aperture in the post section. In a preferred embodiment, the tip includes a guiding rib on an internal cylindrical surface projecting radially towards the external cylindrical surface of the post section. A guiding channel is located on the external cylindrical surface of the post section for receiving the guiding rib and guiding the guiding rib as the tip moves between a closed position and a first and second stage open positions to progressively uncover the aperture. The guiding channel has a trunk section and at least one branch section extending away from the trunk section in the longitudinal and circumferential directions. A first abutment is located at the end of the trunk section and a second abutment is located at an end of the branch section opposite from the trunk section. The trunk section guides the guiding rib as the tip moves axially from the closed position to the first stage open position. The branch section guides the guiding rib as the tip moves axially and rotates from the first stage open position to the second stage open position.

Other objects, advantages and salient features of the invention will become apparent from the following detailed description taken in conjunction with the annexed drawings, which disclose preferred embodiments of the invention.

BRIEF DESCRIPTION OF THE DRAWINGS

The invention will be described with reference to the following drawings in which like reference numerals refer to like elements and wherein.

DETAILED DESCRIPTION OF PREFERRED EMBODIMENTS

Figure 1C:
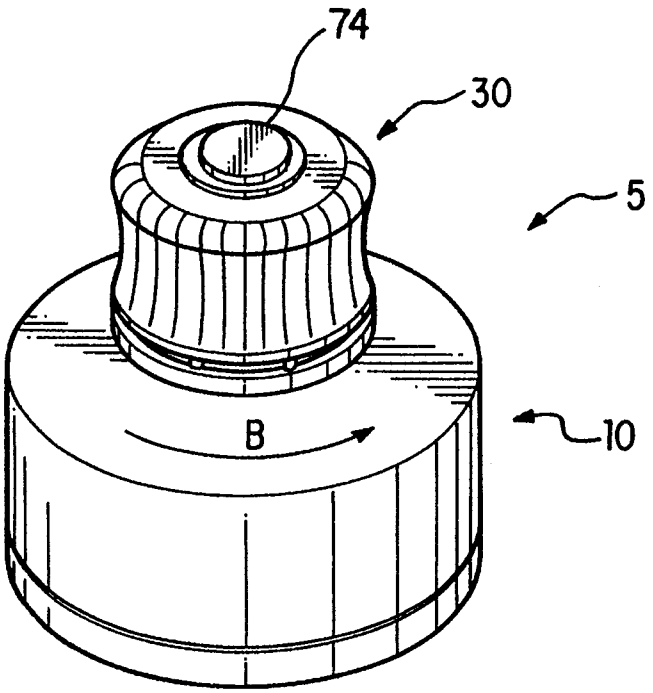
FIG. 1C is an illustration of the tip and the shell in an assembled condition.

FIG. 1C shows a fully assembled cap 5 for attachment to a container (not shown). Preferably, the container is used to hold liquids such as water. The assembled cap 5 includes a tip 30, shown more particularly in FIG. 1A, and a shell 10, shown more particularly in FIG. 1B. All elements of the container and cap are preferably formed of plastic by well known molding techniques. However, the invention is applicable to other materials and manufacturing techniques.

Figure 1B:
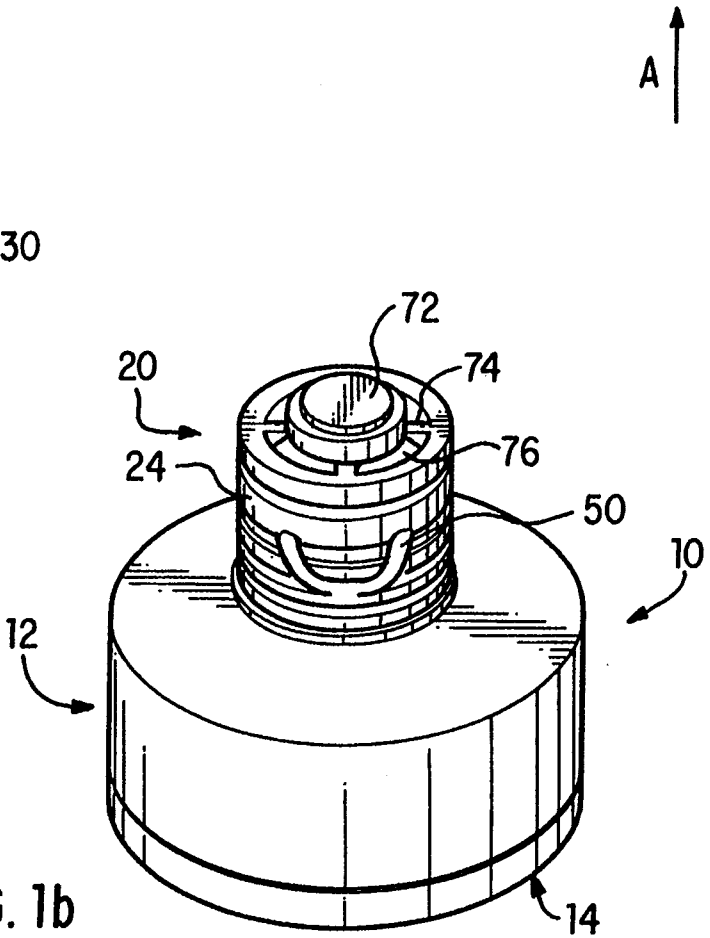
FIG. 1B is an illustration of a shell component of a preferred embodiment.
Figure 3C:
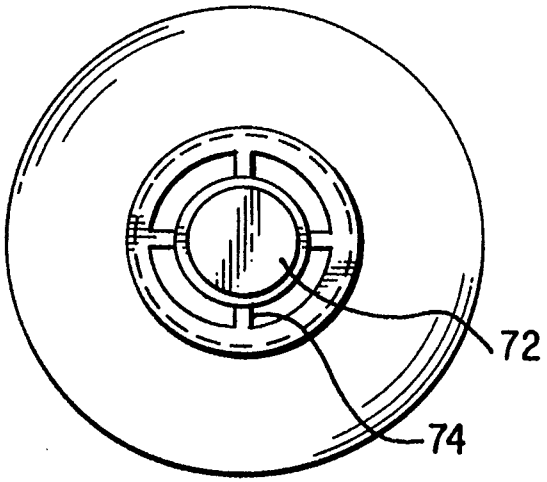
FIG. 3C is a top view of the shell.
Figure 3B:
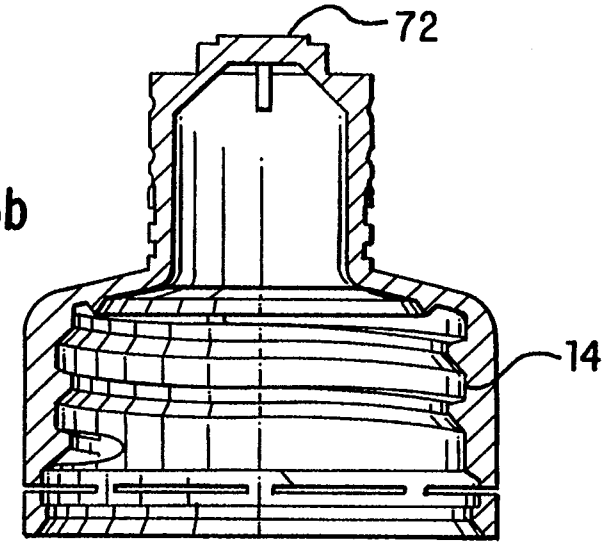
FIG. 3B is a cross-sectional view of the shell.

As shown in FIG. 1B, the shell 10 includes a base section 12 and a post section 20. The base section 12 preferably has a threaded section 14 located on an inner circumferential surface of the base section 12 as shown in FIG. 3B. As is well known in the art, the container (not shown) may contain a receiving threaded section so that the threaded section 14 of the shell 10 may be tightened and securely fastened to the receiving threaded section of the container. Alternatively, the base 12 may include a device to snap the base 12 onto the container in a well known manner. Tamper-proof connections may also be supplied to visually indicate whether the base 12 has been previously detached from the container.

The post section 20 is on an opposite end of the shell 10 from the base section 12, as shown in FIG. 1B. The post section 20 preferably has a substantially hollow cylindrical shape for dispensing fluids through flow apertures 76 in a manner described below. The post section 20 has an external cylindrical surface 24 for securing the tip 30 (FIG. 1A) to the shell 10 as illustrated in FIG. 1C.

Figure 2A:
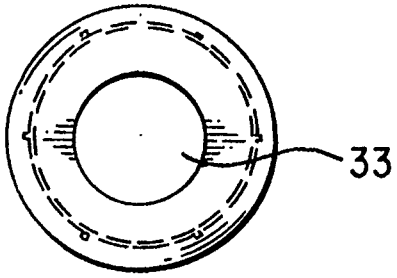
FIG. 2A is a top view of the tip.
Figure 2C:
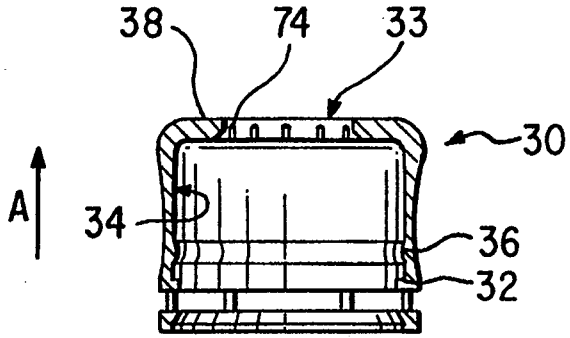
FIG. 2C is a cross-sectional view of the tip.
Figure 2B:
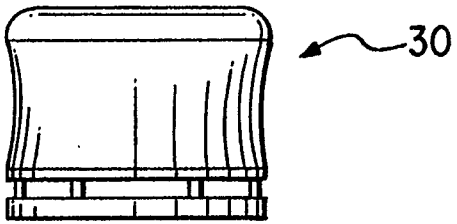
FIG. 2B is a side view of the tip.

As shown in FIG. 2C, the tip 30 has an internal cylindrical surface 34 that covers the external cylindrical surface 24 of the shell 10 when the tip 30 is engaged with the shell 10. A circular opening 33 on a top end of the tip 30 allows fluid in the container to flow from the cap assembly 5 as will be described below. The circular opening 33 is defined by a serrated edge 74 on an upper surface wall 38. The tip 30 covers part or all of the external cylindrical surface 24 of the post section 20 depending on the position of the tip 30 relative to the shell 10. The tip 30 is movable in a longitudinal direction as indicated by arrow A in FIG. 1C and similarly in a direction opposite to arrow A to move relative to the post section 20. The movement of the tip 30 in the longitudinal direction selectively opens and closes the flow apertures 76 of the shell 10 to allow the liquid in the container to flow through the opening 33 of the tip 10 as will be described below. The tip 30 can also rotate about its post section 20 in the directions of arrow B, depending on its longitudinal position on the post section 20. The tip 30 also includes a guiding rib 32, shown in FIG. 2C, that projects radially inward from the internal cylindrical surface 34 of the tip 30.

Figure 3A:
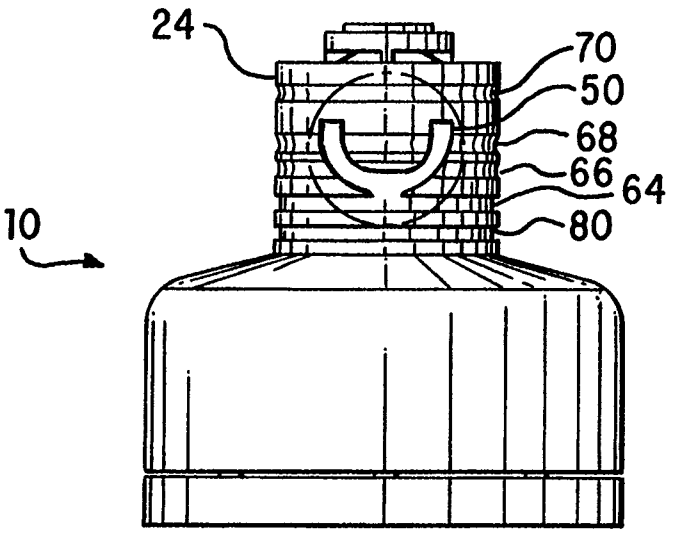
FIG. 3A is a side view of the shell.

As shown in FIG. 3A, the external cylindrical surface 24 of the shell 10 has a guiding channel 50 for receiving and guiding the guiding rib 32 of the tip 30. The guiding channel 50 is preferably cut into the external cylindrical surface 24 to guide the movement of the guiding rib 32 as the tip 30 moves on the post section 20 to open and close the apertures 76, as will be later described.

Figure 4:
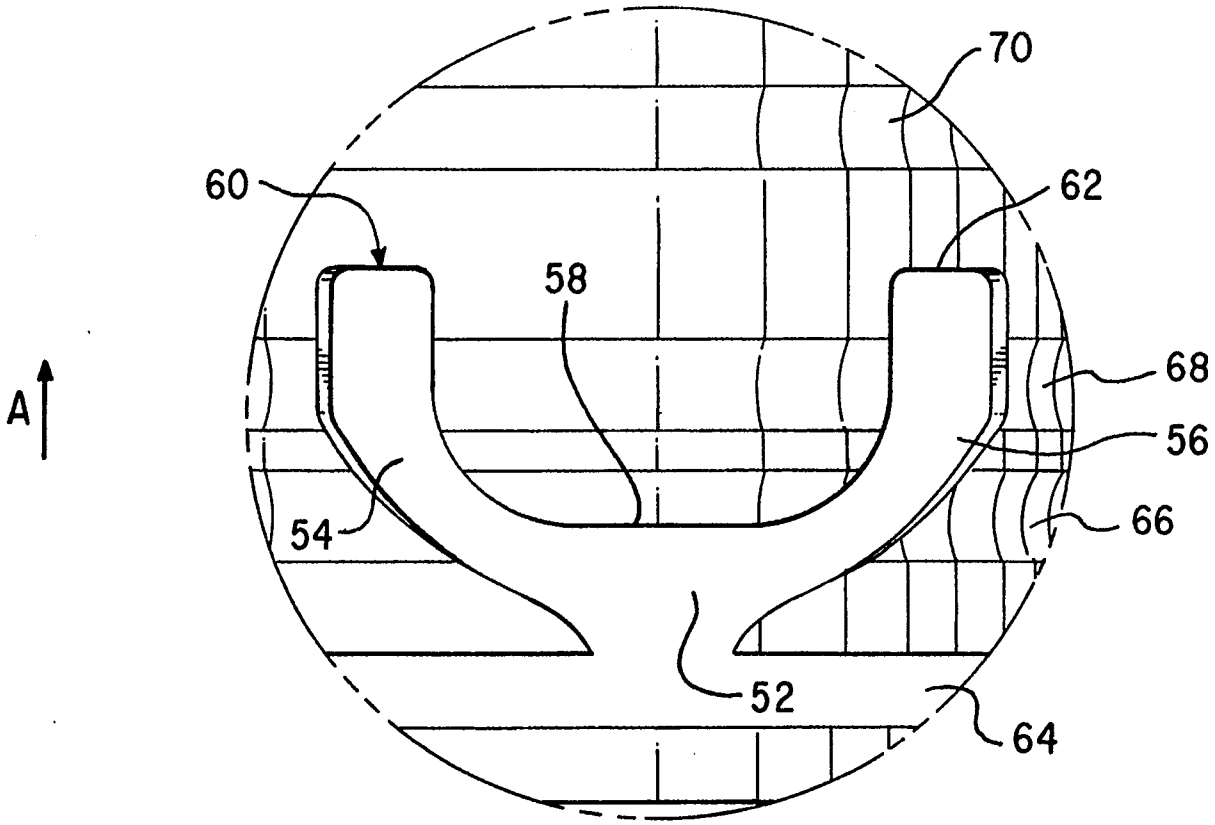
FIG. 4 is an illustration of the guiding channel of a preferred embodiment.

The guiding channel 50 will now be described with reference to FIG. 4, which is an enlarged view of the circled area shown in FIG. 3A. The guiding channel 50 includes a trunk section 52, a left branch section 54 and a right branch section 56. Both the left and right branch sections 54 and 56 extend away in the longitudinal direction A from the trunk section 52. In addition, the left and right branch sections 54, 56 extend in opposite circumferential directions. Preferably, the guiding channel 50 is in the form of a U-shape. Alternatively, the guiding channel may be in the form of a horseshoe or a V-shape. The guiding channel 50 is further defined by a plurality of abutment walls that restrict movement of the guiding rib 32 as will be described. A first abutment 58 is located at an end of the trunk section 52 where the right and left branch sections 54 and 56 connect to the trunk section 52. A second abutment 60 is located at an end of the left branch section 54 opposite from the trunk section 52 while a third abutment 62 is located at an end of the right branch section 56 opposite from the trunk section 52. The entire guiding channel 50 is formed in the external cylindrical surface 24 such that a groove or indentation is formed having a wall or boundary between the guiding channel 50 and the external surface 24. However, the wall of the channel 50 at the first abutment 58, the second abutment 60 and the third abutment 62 may be buttressed to prevent the guiding rib 32 from being forced out of the guiding rib channel 52 as these are locations that the guiding rib 32 may be pressured against the wall boundaries.

An annular guiding groove 64 (FIG. 3A) is circumferentially positioned around the post section 20. Similar to the guiding channel 50, the annular guiding groove 64 may preferably be formed into the external cylindrical surface 24 to a similar depth as the guiding channel 50. The annular guiding groove 64 intersects the trunk section 52 of the guiding channel 50 at an end opposite the first abutment 58. The annular guiding groove 64 receives the guiding rib 32 of the tip 30 and allows rotational movement of the tip 30 in a closed position, as will be described in greater detail below.

The post section 20 additionally includes a closure annular groove 66, a first stage annular groove 68 and a second stage annular groove 70 on the external cylindrical surface 24. Each of these grooves 66, 68 and 70 relates to a specific position or state of the tip 30 relative to the shell 10. FIG. 2C shows the tip 30 having a resilient annular projection 36 that engages with one of the three grooves 66, 68 and 70 of FIG. 3A to restrict longitudinal movement of the tip 30 relative to the shell 10 unless a sufficient amount of force is exerted in a direction of arrow A or a direction opposite to arrow A to move the resilient annular projection 36 out of one of the grooves 66, 68 and 70 to another one of the grooves 66, 68 and 70. Movement of the grooves 66, 68 and 70 are preferably provided to restrict movement of the tip 30 due to forces of gravity. However, as will be described, the restricted circumferential and longitudinal movements of the tip 30 are more clearly defined by the positioning of the guiding rib 32 relative to either the annular guiding groove 64 or the guiding channel 50. It is also understood that other means or devices may be used to restrict longitudinal movement due to gravity of the tip 30 relative to the shell 10.

The method of moving the tip 30 relative to the post section 20 to the various positions will now be described. Initially, the guiding rib 32 of the tip 30 extends into the annular guiding groove 64 of the post section 20. This is considered the closed position at which no fluid is dispensable from the assembled cap assembly 5 because the top of the tip covers the apertures 76. Because the annular guide groove 64 extends circumferentially around the entire post section 20, the tip 30 is easily able to rotate in both the clockwise and counterclockwise directions when in the closed position. The side walls of the annular guide groove 64 prevent the guide rib 32 from moving out from engagement with the annular guide groove 64. Therefore, in the closed position, the tip 30 and the shell 10 are maintained at the same longitudinal height relative to each other, although the tip 30 is freely rotatable about the circumferential annular guide groove 64. In the closed position, the resilient annular projection 36 is engaged with the closure annular groove 66 as may be seen in FIG. 5A.

Figure 5B:
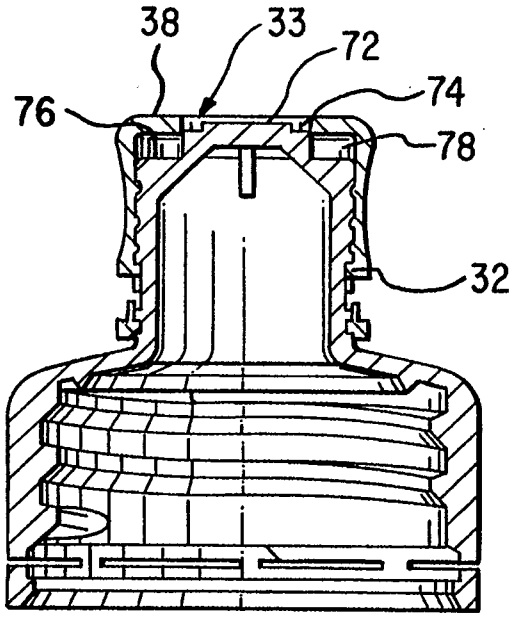
FIG. 5B is a cross-sectional view of the assembled multi-position cap in a spray position.

To open the tip 30 relative to the shell 10, the tip 30 is rotated in either direction of arrow B of FIG. 1C until the guiding rib 32 is positioned in the annular guide groove 64 directly under the trunk branch 52 of the guiding channel 50. Markings on both the tip 30 and the shell 10 may aid the user to correctly position the guiding rib 32. In this position, the tip 30 is manually pulled in the direction of arrow A to cause the guiding rib 32 to slide from the annular guide groove 64 into the trunk branch 52 of the guiding channel 50. The tip 30 is pulled until the guiding rib 32 abuts against the first abutment 58. This is considered the spray position and is generally shown in FIG. 5B. During the movement of the guiding rib 32 from the annular guide groove 64 to the trunk branch 52, the resilient annular projection 36 on the tip 30 disengages from the closure annular groove 66 and is moved into engagement with the first stage annular groove 68. Due to this engagement between the annular projection 36 and the first stage annular groove 68, the guiding rib 32 is maintained at a position against the first abutment 58 so that the tip 30 does not move in a direction opposite arrow A unless the tip 30 is pulled or depressed with sufficient force to remove the annular projection 36 from the first stage annular groove 68.

To fully open the tip 30 from the spray position to a pour position, the tip 30 is rotated in either a counter-clockwise direction, as indicated by arrow B, or a clockwise direction. If the tip 30 is rotated in a clockwise direction, the guiding rib 32 slides in the guiding channel 50 from the trunk branch 52 to the left branch 54. The tip 30 is further rotated in the clockwise direction while moving longitudinally until the guiding rib 32 abuts against the second abutment 60. The longitudinal and circumferential direction of the left branch 54 allows the tip 30 to move both circumferentially and longitudinally based on the user merely rotating the tip 30. Once the guiding rib 32 abuts the second abutment 60, the second abutment 60 prevents any further clockwise movement of the tip 30. This is considered a pour position. In this position, the resilient annular projection 36 on the tip 30 engages with the second stage annular groove 70 to maintain the longitudinal displacement of the tip 30 relative to the shell 10 unless a sufficient force is exerted on the tip in a direction opposite to arrow A.

Figure 5C:
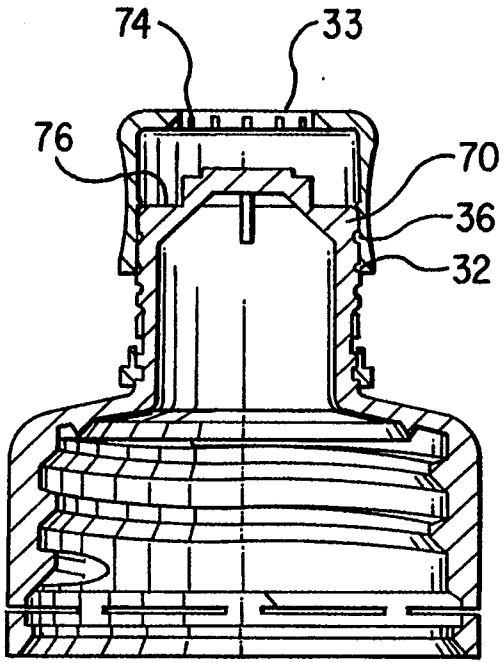
FIG. 5C is a cross-sectional view of the assembled multi-position cap in a pour position.

In similar manner to clockwise rotation of the tip 30, the tip 30 may be rotated in a counter-clockwise manner as shown by arrow B from the spray position to the pour position. When the tip 30 is rotated counter-clockwise, the guiding rib 32 slides from the trunk branch 52 to the right branch 56 until the guiding rib 32 abuts against the third abutment 62. The third abutment 62 prevents any further clockwise movement of the tip 30 while in this position. When the tip 30 rotates in a counter-clockwise direction, the resilient annular projection 36 disengages with the first stage annular groove 68 and is moved into engagement with the second stage annular groove 70. FIG. 5C shows the relationship of the tip 30 and the shell 10 while in the pour position.

When the user desires to change from a pour position to either the spray or closed position, the user simply depresses the tip 30 in a direction opposite the arrow A. The depression of the tip 30 causes the guiding rib 32 to slide through either the left branch 54 or right branch 56 to the trunk branch 52. This causes the resilient annular projection 36 to disengage from the second stage annular groove 70 and engage with the first stage annular groove 68. Subsequently, if it is desired to move to the closed position, the tip 30 is further depressed so that the annular projection 36 disengages with the first stage annular groove 68 and is forced downward to engage with the closure annular groove 66. This causes the guiding rib 32 to slide in a direction opposite arrow A out from the trunk branch 52 into the annular guiding groove 64.

Figure 5A:
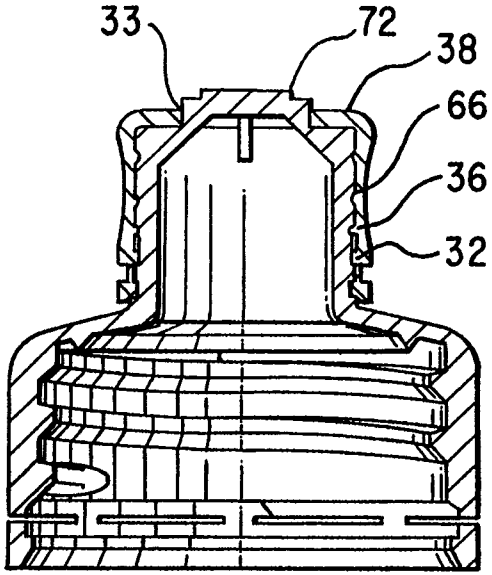
FIG. 5A is a cross-sectional view of the assembled multi-position cap in a closed position.

The post section 20 additionally includes a circular platform 72 located at the end of the post section opposite the base section 10. When the cap assembly 5 is in a closed position such as shown in FIG. 5A, the platform 72 extends through the opening 33 of tip 30. Preferably, the platform 72 is connected to the substantially hollow cylindrical post section 20 by support arms 74. As shown in FIG. 1B, the platform 72 and support arms 74 define flow apertures 76 between the base of the platform 72 and the post section 20. When the cap assembly 5 is in the closed position as shown in FIG. 5A, the upper surface 38 of tip 30 defining the opening 33 completely covers all of the flow apertures 76. This prevents any liquid in the container (not shown) from exiting through the flow apertures 76.

Figure 1A:
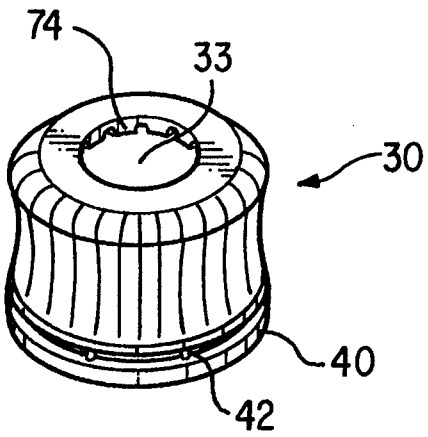
FIG. 1A is an illustration of a tip component of a preferred embodiment of the invention.

When the tip 30 is subsequently moved into a spray position as shown in FIG. 5B, the upper surface 38 of the tip 30 no longer completely covers the flow aperture 76. However, in this position, any liquid passing through the flow apertures 76 cannot directly flow through the opening 33 because a direct flow path has not yet been created. To achieve a spray effect, the tip 30 has a serrated edge 74 surrounding the circular opening 33, as shown in FIG. 1A. Accordingly, when the tip 30 is in the spray position, the liquid in the container flows through the flow apertures 76 into a recess 78 defined by the upper edge 38 of the tip 30 and flows through the serrated edge 74 of the tip 30 to spray the liquid.

Finally, when the tip 30 is moved into a pour position, such as shown in FIG. 5C, the flow apertures 76 are similarly uncovered so the liquid may freely flow out from the container. However, in the pour position, no recess 78 is formed. Therefore, the liquid is able to pass directly from the container out through the flow apertures 76 and through the opening 33.

The tip 30 may additionally include a tamper-proof ring 40 located along a circumferential edge on an end of the tip 30 opposite the opening 33 as shown in FIG. 1A. The tamper-proof ring 40 is connected to the tip 30 by frangible connections 42 as is well known in the art. The post section 20 will additionally include a retention groove 80, shown in FIG. 3A, located around a circumferential edge of the post section 20 at a location of the tamper-proof ring 40 when the tip 30 is in the closed position. As is well known, the retention groove 80 retains the tamper-proof ring 40 when the tip 30 is initially in the closed position. The frangible connections 42 are subsequently broken when the tip 30 is either moved in a direction of arrow A or in a clockwise or counter-clockwise rotational direction.

Other embodiments of the invention are similarly within the scope of this invention. For example, the tip 30 may include two or more guide ribs 32 and the post section 20 may include two or more guiding channels 50 such that each of the guide ribs corresponds to one of the guiding channels 50. Preferably, each guide rib 32 and each of the guiding channel 50 are located on opposite sides of the respective part. Therefore, each would be separated from each other by 180°. In another embodiment, the guiding rib 32 may be mounted on the post section 20 while the guiding channel 50 is mounted on the tip 30. The operation of such an embodiment would be identical to that disclosed above.

The invention has been described with reference to preferred embodiments, which are intended to be illustrative and not limiting. Many modifications and variations are apparent from the foregoing description of the invention, and all such modifications are intended to be within the scope of the present invention. Accordingly, variations of the present invention may be made without departing from the spirit and scope of the present invention as defined in the following claims.

What is claimed is:

1. A multi-position self-guiding cap for attachment to a container, comprising:

a shell having an attachment section for attachment to the container and a post section with an aperture for dispensing fluids from the container, the attachment and post sections being aligned along a longitudinal axis of the shell, the post section having an external cylindrical surface;

a tip mounted on the external cylindrical surface of the post section for axial movement in a longitudinal direction relative to the attachment section and rotational movement in a circumferential direction relative to the attachment section to selectively open and close the aperture in the post section, the tip having an internal cylindrical surface with a guiding rib projecting radially toward the external cylindrical surface of the post section; and a guiding channel on the external cylindrical surface of the post section for receiving the guiding rib and guiding the guiding rib as the tip moves between a closed position in which the tip closes the aperture and first and second stage open positions in which the tip moves away from the attachment section to progressively uncover the aperture, the guiding channel having a trunk section extending in the longitudinal direction and at least one branch section extending away from the trunk section in the longitudinal and circumferential directions, a first abutment located at an end of the trunk section and a second abutment located at an end of the branch section opposite from the trunk section, the trunk section guiding the guiding rib as the tip moves axially from the closed position to the first stage open position where the guiding rib contacts the first abutment, and the branch section guiding the guiding rib as the tip moves axially and rotates from the first stage open position to the second stage open position where the guiding rib contacts the second abutment.

2. The cap of claim 1, wherein the guiding channel has two branch sections extending from the trunk section in opposite circumferential directions so the tip can rotate clockwise and counter-clockwise around the post section.

3. The cap of claim 2, wherein the guiding channel is U-shaped with the first abutment located at an intersection of the truck section and the two branch sections.

4. The cap of claim 1, further comprising an annular guiding groove extending circumferentially about the post section and intersecting the trunk section for guiding the guiding rib into the trunk section, the annular guiding groove allowing rotational movement of the tip in the closed position.

5. The cap of claim 1, further comprising retention means for preventing movement of the tip from the first stage open position to the closed position and from the second stage open position to the first stage open position unless the tip is depressed toward the attachment section.

6. The cap of claim 1, wherein:

the external surface of the post section includes at least three annular grooves: a first stage annular groove between the trunk section of the guiding channel and the aperture, a second stage annular groove between the first stage annular groove and the aperture, and a closure annular groove between the first stage annular groove and the attachment section; and the internal surface of the tip includes a resilient annular projection selectively received in one of the three annular grooves, the annular projection being received within the closure annular groove when the tip is in the closed position to maintain the tip in the closed position, the annular projection being received within the first stage annular groove when the guiding rib contacts the first abutment to maintain the tip in the first stage open position, and the annular projection being received within the second stage annular groove when the guiding rib contacts the second abutment to maintain the tip in the second stage open position.

7. The cap of claim 1, wherein the attachment section comprises a threaded section.

8. The cap of claim 1, wherein:

the post section has one end connected to the attachment section and a second opposite end connected to a platform located radially within the external cylindrical surface of the post section such that the aperture is defined in the second end between the platform and the external cylindrical surface of the post section;

the platform having an internal surface facing the attachment section, an external surface opposite the internal surface, and a peripheral surface between the external and internal platform surfaces;

the tip includes a top wall surface and an opening defined by a serrated edge of the top wall surface, the opening corresponding in size and shape to the platform, the serrated edge of the top wall surface extending into contact with the peripheral surface of the platform; and the top wall surface covers the aperture when the tip is in the closed position so that fluid is prevented from flowing from the container, the top wall surface is removed from the aperture when the tip is in the first stage open position to define spray nozzles between the serrated edge and the platform for dispensing fluid from the container in a spray through the spray nozzles, and the top wall surface is removed from the aperture when the tip is in the second stage open position to define a flow channel through the opening for dispensing a flow of fluid from the container.

9. The cap of claim 8, wherein the platform is supported by support arms extending radially inward from the post section.

10. The cap of claim 9, wherein the support arms extend axially away from the attachment section so that the platform is radially within the external cylindrical surface of the post section and extends axially beyond the post section.

11. The cap of claim 1, wherein the tip includes a tamper-proof ring depending from the tip toward the attachment section and connected to the tip by a frangible connection, and the post section includes an annular retention groove for retaining the tamper-proof ring when the tip is in the closed position, the frangible connection breaking to separate the tamper-proof ring from the tip when the tip is first moved in one of a longitudinal, clockwise and counter-clockwise direction.

12. The cap of claim 1, wherein the branch section guides the guiding rib as the tip moves axially from the second stage open position to the first stage open position and the trunk section guides the guiding rib as the tip moves axially from the first stage open position to the closed position.

13. A multi-position self-guiding cap for attachment to a container, comprising:

a shell having a attachment section for attachment to the container and a post section with an aperture for dispensing fluids from the container, the attachment and post sections being aligned along a longitudinal axis of the shell, the post section having an external cylindrical surface;

a tip mounted on the external cylindrical surface of the post section for axial movement in a longitudinal direction and rotational movement in a circumferential direction relative to the attachment section to selectively open and close the aperture in the post section; one of an internal surface of the tip and the external surface of the post section having a guiding rib; and the other of the internal surface of the tip and the external surface of the post section having a guiding channel for receiving the guiding rib and guiding the guiding rib as the tip moves between a closed position in which the tip closes the aperture and first and second stage open positions in which the tip moves away from the attachment section to progressively uncover the aperture, the guiding channel having a trunk section extending in the longitudinal direction and at least one branch section extending away from the trunk section in the longitudinal and circumferential directions, a first abutment located at an end of the trunk section and a second abutment located at an end of the branch section opposite from the trunk section, the trunk section guiding the guiding rib as the tip moves axially from the closed position to the first stage open position where the guiding rib contacts the first abutment, and the branch section guiding the guiding rib as the tip moves axially and rotates from the first stage open position to the second stage open position where the guiding rib contacts the second abutment.

* * * * *